US005230186A

United States Patent [19]

Hammonds et al.

[11] Patent Number: 5,230,186

[45] Date of Patent: Jul. 27, 1993

[54] PLAYGROUND SYSTEM

[75] Inventors: G. Thomas Hammonds; Carl A. Slear, both of Butler, Pa.

[73] Assignee: Iron Mountain Forge, Farmington, Mo.

[21] Appl. No.: 864,320

[22] Filed: Apr. 6, 1992

[51] Int. Cl.[5] ..... E04H 3/00

[52] U.S. Cl. ..... 52/79.6; 52/263

[58] Field of Search ..... 52/87, 127.2, 79.6, 52/263, 299, 301, 712, 715

[56] References Cited

U.S. PATENT DOCUMENTS

| | | | |
|---|---|---|---|
| 4,691,484 | 9/1987 | Wilson | 52/79.6 |
| 4,823,529 | 4/1989 | Canfield et al. | 52/263 |
| 4,852,309 | 8/1989 | Stamp, Sr. | 52/79.6 |

OTHER PUBLICATIONS

Iron Mountain Forge, Buyer's Guide (14th Edition), pp. 10-63, 1991, Farmington, Missouri.

GameTime, Family Fun'n Fitness, pp. 36-39, 1991, Fort Payne, Alabama.

Quality Industries, Inc., Catalog No. 1091, pp. 1-4 and 7-8, Circa, 1991, Hillsdale, Michigan.

SMP Limited, SMP Playgrounds, pp. 10-13, Circa, 1988, Surrey, England.

Big Toys, Big Toys, pp. 6-7 and 12-13, 1991, Olympia, Washington.

Landscape Structures Inc., Park & Playground Equipment, pp. 50-53, 1991, Delano, Minnesota.

Kompan Inc., Kompan, pp. 8-9, 108-109 and 116-117, 1990, Windsor Locks, Connecticut.

*Primary Examiner*—Carl D. Friedman

*Assistant Examiner*—Creighton Smith

*Attorney, Agent, or Firm*—Senniger, Powers, Leavitt & Roedel

[57] ABSTRACT

A playground system including a basic play unit having four corner posts installed upright in a first generally rectangular post formation with the posts at the corners of the formation. A first rectangular frame of the basic play unit includes four side rails, one at each side of the frame and corner brackets connecting the side rails at the four corners of the frame. Fasteners connect the brackets to the posts with the side rails in a generally horizontal plane thereby to provide a rigid, stable structure. Deck boards secured alongside one another to the side rails form decking overlying the frame. At least one adjunct play unit, installed as an adjunct to the basic play unit, includes an anchor portion secured adjacent the basic play unit as by burying in the ground, and a connector portion for connecting the adjunct play unit to the basic play unit. The connector portion is a bracket having first and second legs extending generally at right angles to one another. The first and second legs engage adjoining faces of the basic play unit and are fastened to the basic play unit.

13 Claims, 4 Drawing Sheets

PLAYGROUND SYSTEM

BACKGROUND OF THE INVENTION

This invention relates generally to playground equipment and more particularly to a playground equipment system having a basic play unit configurable with a combination of adjunct play units.

Playground equipment may include several distinct play units connected together. For example, a slide, overhead bars, an arch and a firepole may all be interconnected such as by one or more decks so that a child may reach all of these play units from the deck. Of course, numerous other distinct play units could be added, including other decks. There is presently a need for such playground equipment of modular construction which remains rigid and stable as play units are added to the system.

SUMMARY OF THE INVENTION

Among the several objects and features of the present invention may be noted the provision of a playground system which allows a high degree of flexibility in the choice and arrangement of play units making up the system; the provision of such a system which is structurally stabilized and strengthened with by addition of a play unit thereto; the provision of such a system in which the play units are capable of easy and secure connection to a basic play unit; and the provision of such a system which is economical to manufacture and easy to assemble.

Further among the several objects and features of the present invention may be noted the provision of a deck assembly capable of forming a basic play unit to which adjacent play units may be selectively attached thereto at a number of locations; the provision of such a deck assembly on which deck boards may be easily and quickly mounted; the provision of such a deck assembly which may be securely connected to supporting posts to form a rigid structure; the provision of such a deck assembly having components formed for light weight and strength; and the provision of such a deck assembly which is economical to manufacture and easy to assemble.

Generally, a playground system constructed according to the principles of the present invention comprises a basic play unit including four corner posts installed upright in a first generally rectangular post formation with the posts at the corners of the formation. A first rectangular frame includes four side rails, at respective sides of the frame. Fasteners connect the side rails to the posts at the four corners of the frame, with the side rails in a generally horizontal plane thereby to provide a rigid, stable structure. Deck boards are secured alongside one another to the side rails to form decking overlying the frame. The system further includes at least one adjunct play unit for installation as an adjunct to the basic play unit, the adjunct play unit comprising an anchor portion adapted to be secured adjacent the basic play unit as by burying in the ground, and a connector portion for connecting the adjunct play unit to the basic play unit. The connector portion comprises a bracket having first and second legs extending generally at right angles to one another for engaging adjoining faces of the basic play unit. Fasteners are provided for connecting the bracket to the basic play unit.

A deck assembly constructed according to the principles of the present invention comprises four corner posts adapted to be installed upright in a generally rectangular post formation with the posts at the corners of the formation. Each post has a pair of adjoining faces lying in generally perpendicular planes. The deck assembly further includes a generally rectangular frame defined by a plurality of side rails at respective sides of the frame and four corner brackets connecting the side rails at the four corners of the frame. Each bracket has first and second legs extending generally at right angles to one another for face-to-face engagement with said pair of adjoining faces of a respective post. Means fastens the brackets to the posts with the side rails in a generally horizontal plane and with the posts received in said corner brackets with the first and second legs of each bracket in engagement with said pair of adjoining faces of a respective post. The first and second legs of each corner bracket are dimensioned for engaging said pair of adjoining faces of a respective post over large areas of the post whereby when the brackets are fastened to the posts, the posts and frame are rigidly connected to form a stable unit. Deck boards are secured alongside one another to the side rails to form decking overlying the frame.

Other objects and features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENTS

Figure 1:
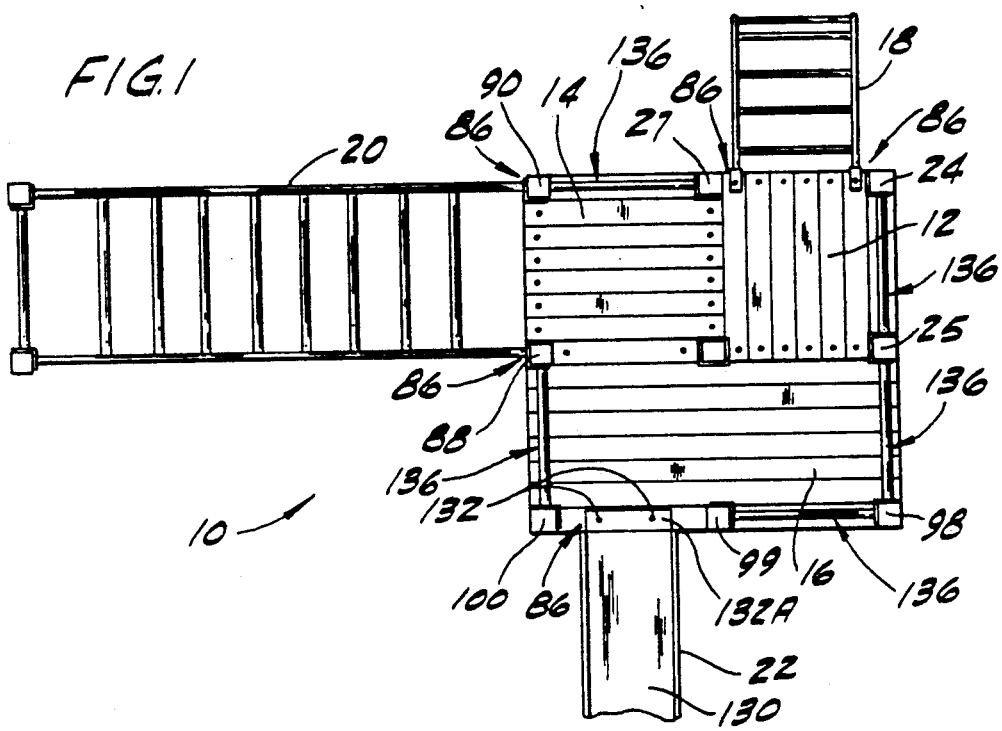
FIG. 1 is a top plan of an assembled playground system.

Referring now to the drawings, and in particular to FIG. 1, a modular playground system 10 of the present invention is shown to comprise a basic play unit 12 and five adjunct play units, indicated by reference numerals 14–22, respectively. The basic play unit 10 and the adjunct play units 14 and 16 are deck assemblies. The adjunct play unit 18 is an arch, the unit 20 is a set of overhead bars, and unit 22 is a slide. Of course, the playground system 10 may have other or different adjunct play units, including a spiral slide, a corkscrew, a firepole, a ribbon slide, a chinning bar, a bridge and a chain walk, (all not shown) to name a few. The basic and adjunct play units may also be arranged in different configurations and still fall within the scope of the present invention.

Figure 2:
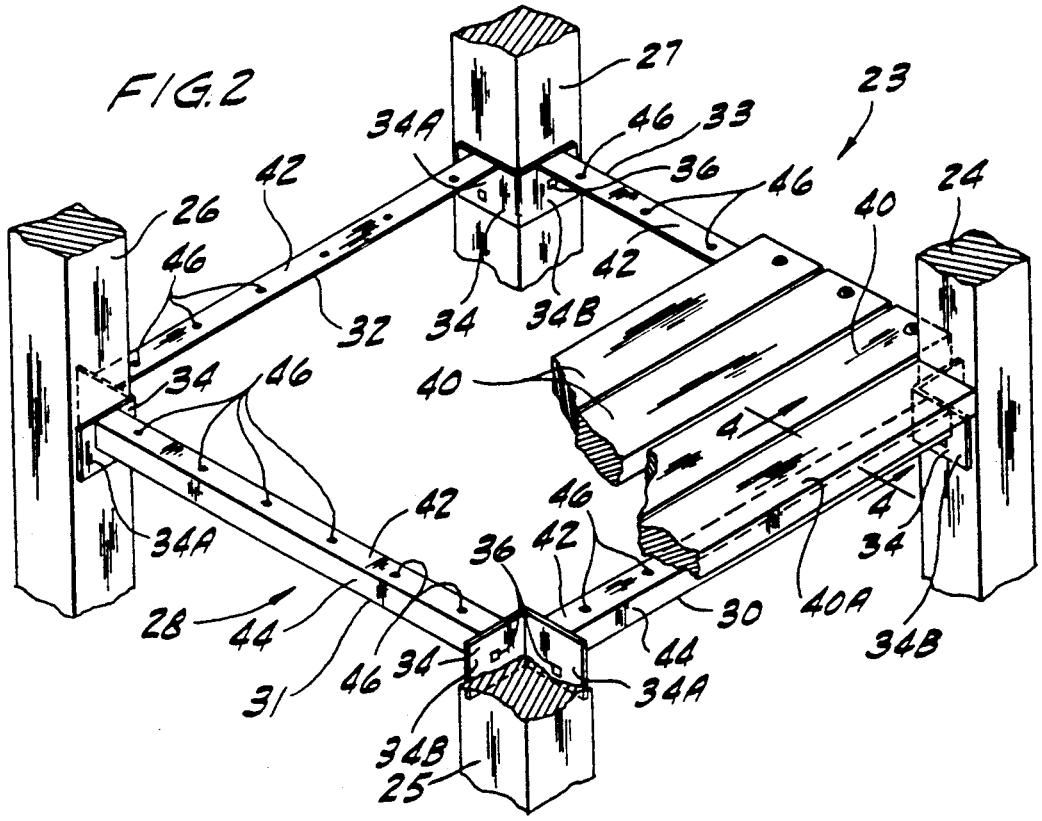
FIG. 2 is a perspective of a deck assembly of a first embodiment.

The basic play unit 12 shown in FIG. 1, is a deck assembly of a first embodiment like the deck assembly 23 shown in FIG. 2, including four wooden corner posts (designated generally by reference numerals 24–27) installed upright in a first generally rectangular post formation with the posts at the corners of the formation. A first rectangular frame 28 including four side rails (designated 30–33), one at each side of the frame, has corner brackets, indicated generally at 34, which connect the side rails at the four corners of the frame. The frame 28 is symmetric about both a first central vertical plane extending generally at right angles to a pair of parallel side rails of the frame and bisecting the frame, and a second vertical plane extending generally at right angles to the first plane and which also bisects the frame. Each corner bracket 34 has a first leg 34A and a second leg 34B extending generally at right angles to one another for face-to-face engagement with a pair of adjoining faces of one of the posts. Openings 36 in each leg 34A, 34B receive a suitable fastener, such as a bolt 38, for securely fastening the frame 28 to the posts 24–27 with the posts received in the corner brackets 34 and with the side rails 30–33 in a generally horizontal plane thereby providing a rigid, stable structure. Deck boards 40 made of wood are secured alongside one another to the side rails 30–33 to form decking overlying the frame 28.

The rigidity and stability of the deck assembly 23 is facilitated by anchoring the lower portions of the posts 24–27, such as by burying in the ground. In addition, the corner brackets 34 are dimensioned for engaging adjoining faces of the posts over a large area of the posts. As may be seen in FIG. 2, each corner bracket 34 is generally L-shaped, and the legs 34A, 34B open outwardly away from the interior of the rectangular metal frame 28. The faces of the legs 34A, 34B which engage the adjoining faces of the posts 24–27 have substantially the same width as the post faces, and are in a preferred embodiment about 3 to 4 inches in vertical dimension. The large surface areas of engagement between the brackets 34 and the posts 24–27 rigidly support the frame 28.

Figure 4:
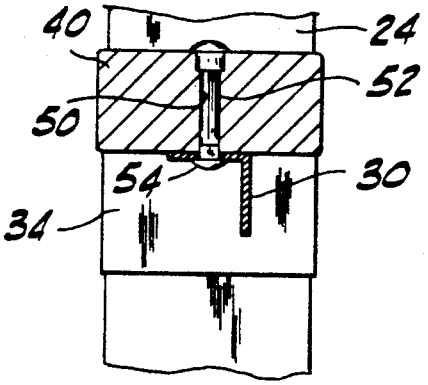
FIG. 4 is a cross section taken in the plane including line 4—4 of FIG. 2.

The side rails 30–33 of the frame 28 are angle bars having a top leg 42 lying in a generally horizontal plane and a depending side leg 44 extending generally at right angles to the top leg. The corner brackets 34 are attached such as by welding to the longitudinal ends of adjacent side rails 30–33 of the frame 28. The width of the top leg 42 of each side rail is less than the length of the corner bracket legs 34A, 34B (FIG. 2). The top leg 42 of each side rail has a plurality of holes 46 in it for receiving fasteners to fasten the deck boards 40. As shown in FIG. 4, the deck boards 40 are formed with a bore 50 for receiving a bolt 52 which also passes through one of the holes 46 in the top leg 42 of the side rail. In the preferred embodiment, the bolt 52 has a hollow, internally threaded shank 52A and a flat, rounded head 52B with a socket (not shown) formed in it. Such bolts 52 are generally of the type sold by Iron Mountain Forge, Inc. of Farmington, Mo., under the trade name Wonder Bolt. A carriage bolt 54 is threadable upwardly through the hole 46 into the bolt 52 for securing the deck boards 40 to the frame 28. The deck boards 40 are pre-cut and pre-bored so that to assemble the decking, the deck boards are laid side-by-side on the frame 28, with the bores 50 in the boards lining up with holes 46 in the top legs 42 of the side rails, and secured with the bolts 52 and nuts 54. Shorter deck boards 40A are mounted over the side rails 30 and 32 between the posts 24 and 25, and posts 26 and 27. As explained more fully below, the holes 46 in the side rails 30–33 also facilitate the attachment of adjunct play units to the basic play unit 12.

Figure 3:
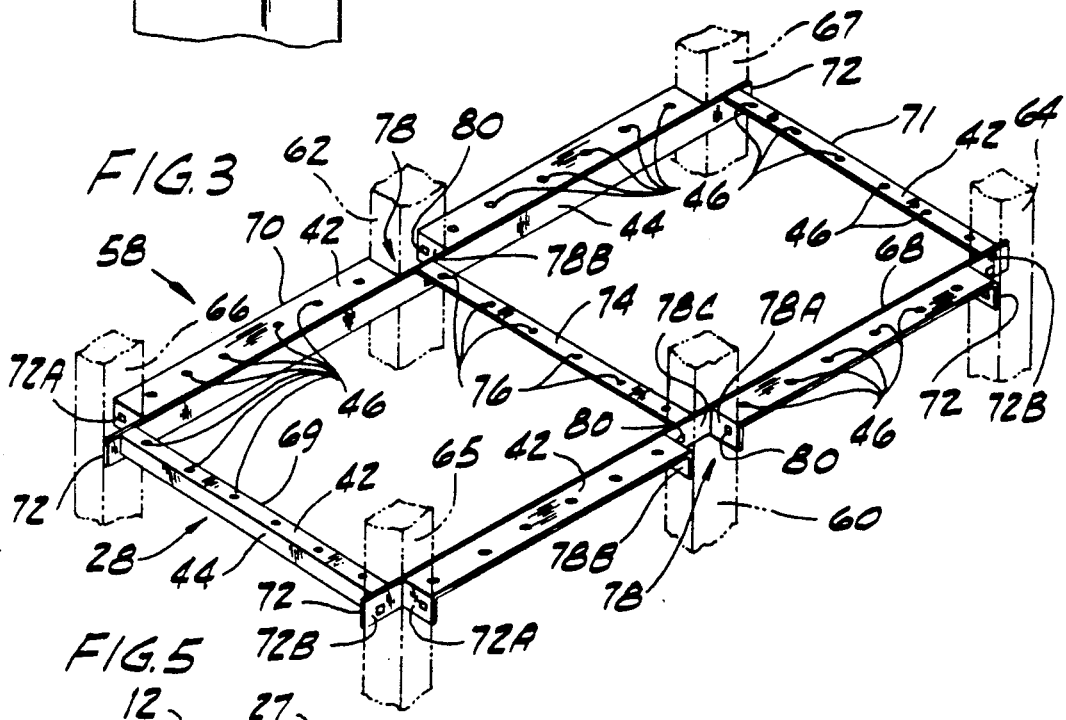
FIG. 3 is a perspective view of a deck assembly of a second embodiment.

Referring now to FIG. 3, a deck assembly of a second embodiment of the present invention, indicated generally at 58, includes a pair of side posts 60, 62 which can be installed in the rectangular post formation defined by posts 64, 65, 66 and 67, so that there are three posts (64, 60 and 65) along one side of the formation and three posts (66, 62 and 67) along an opposite side of the formation. The posts 60, 62 and 64–67 are shown in phantom in FIG. 3. The frame includes four side rails (designated generally 68–71) and four corner brackets 72 located at the intersections of the ends of the side rails. The corner brackets 72 each have legs indicated at 72A and 72B, respectively, generally at right angles to each other for face-to-face engagement with a pair of adjoining faces of one of the posts 64, 65, 66, 67. Unlike the deck assembly 23, the side rails 68 and 70 are substantially longer than the side rails 69 and 71. In the preferred embodiment, the deck assembly 58 is twice the size of the deck assembly 23. The side rails 68–71 have top legs 42 and depending side legs 44 extending generally at right angles to the top leg. The top legs 42 of the longer side rails 68, 70 are formed from elongate sheets of metal bent down at the ends, and attached to a flat, outwardly facing surface of the side rails in a suitable fashion, such as by welding. The top legs 42 of the longer side rails 68, 70 are wider than the top legs 42 of the shorter side rails 69, 71, and are coextensive with the legs 72A of the corner brackets 72 located at the ends of the top legs. The legs 72A are formed by the downwardly bent ends of the sheet of metal forming the top legs 42 of the side rails 68, 70.

The top legs 42 have a plurality of fastener holes 46 for receiving fasteners (e.g., bolts 52 and nuts 54) to fasten deck boards 40 to the rails. A cross piece 74 attached at each end to respective side rails 68, 70, extends transversely between the side rails and generally bisects the deck assembly 58. The cross piece 74 has holes 76 corresponding to holes 46 in the side rails 68–71. The deck boards 40 used with the deck assembly 58 are about twice as long as those used for the deck assembly 23, and are placed on the frame so that they extend lengthwise between the side rail 69 and the side rail 71, over the cross piece 74. Openings in these deck boards align with holes 46 in the side rails 69, 71 and holes 76 in the cross piece 74 for receiving fasteners such as bolt 52. Shorter deck boards (not shown, but identical to deck boards 40A) are attached between posts 64 and 65, and side post 60, and between posts 66 and 67, and side post 62.

Two generally U-shaped brackets, generally indicated at 78, which open outwardly away from the interior of the frame, receive the side posts 60, 62. The U-shaped brackets 78 have two opposing side legs 78A, 78B extending generally perpendicular to the length of the side rail (68 or 70) from which they project, and a connecting leg 78C joining the two opposing side legs and extending generally at right angles to the side legs. The legs 78A, 78B are formed by downwardly turned ends of the sheet of metal forming the top legs 42 of the side rails 68, 70. The side legs 78A, 78B and connecting leg 78C each have an opening 80 for receiving a fastener to attach the U-shaped brackets 78 to the side posts 60, 62. The legs 78A, 78B, 78C engage the side posts 60, 62 over a large area so that the deck assembly 58 is rigid and stable. The connecting legs 78C of the U-shaped brackets are an integral extension of the depending side legs 44 of the longer side rails 68, 70. The top legs 42 of the longer side rails 68, 70 have substantially the same width as the length of the side legs 78A, 78B of the U-shaped brackets, but the top legs 42 of the shorter side rails 69, 71 have a width less than the length of the side legs of the U-shaped brackets.

Figure 9:
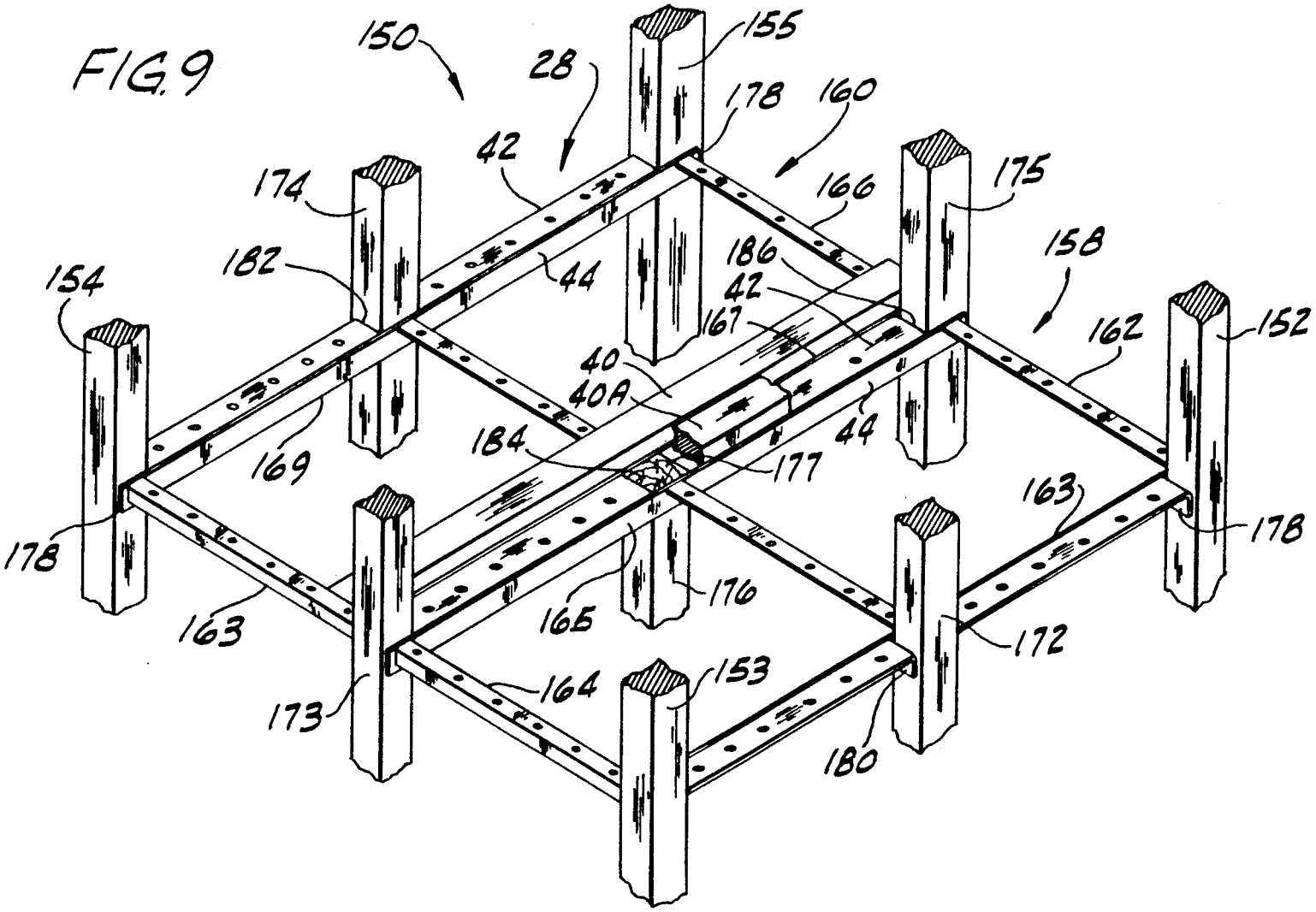
FIG. 9 is a perspective of a deck assembly of a third embodiment.

As shown in FIG. 9, a deck assembly of a third embodiment, indicated generally at 150, includes four corner posts (designated 152, 153, 154 and 155, respectively) in a generally rectangular post formation with each post having a pair of adjoining faces lying in generally perpendicular planes. The frame 28 comprises a first generally rectangular subframe 158 and a second generally rectangular subframe 160, each defined by four side rails (designated by respective reference numerals 162–165 and 166–169), one at each side of the subframes. The sides of the frame 28, made up of the first and second subframes 158, 160, are defined by side rail 163 of the first subframe, side rail 169 of the second subframe, aligned side rails 162, 166 of the first and second subframes, and aligned side rails 164, 168 of the first and second subframes. The remaining two side rails 165, 167 of the subframes are located generally adjacent one another, and extend across the frame.

Four side posts (designed 172, 173, 174 and 175) are installed in the rectangular post formation generally intermediate the corner posts 152–155, and a center post 176 is located generally in the middle of the rectangular post formation. The center post 176 has a flat upper surface 177 lying in the plane of the top legs of the side rails. Thus, the deck assembly 150 has no obstructions in its middle. Brackets 178 are located at the four corners of the frame 28 (two brackets being associated with each subframe) and are of identical construction as the corner brackets 72 of the deck assembly 58. The brackets 178 have openings for receiving fasteners (not shown) to attach the brackets to the adjoining faces of respective posts 152, 153, 154, 155. The first subframe 158 has a single U-shaped bracket 180, of identical construction to the U-shaped brackets 78 of the deck assembly 58, which receives the side post 172 and is fastened to the side post. The second subframe has two U-shaped brackets, indicated at 182 and 184, respectively, which are also of the same construction as U-shaped brackets 78. The U-shaped bracket 182 receives the side post 174 and the U-shaped bracket 184 receives the center post 176. The second subframe 160 also includes brackets 186 of the same construction as corner brackets 178, which receive the side posts 173, 175 for fastening thereto.

The second subframe 160 has the same construction as the frame of the deck assembly 58, shown in FIG. 3. The first subframe 158 is of substantially the same construction as the frame of the deck assembly 58, except that it lacks corner brackets 72 on two of its corners and one of the U-shaped brackets 78 along the side rail 165. The side rail 165 comprises a side leg 44 having a flat, outwardly facing surface, but has no top leg 42 like the other side rails. The side leg 44 has openings in it to receive fasteners for connecting the side rail 165 to the side posts 173, 175 and center post 176. The construction of the side rail 165 allows the first subframe 158 to be attached to the posts 173, 175, 176 at the same height as the second subframe 160 without interference with the legs of the U-shaped bracket 184 or the legs of the brackets 186 of the second subframe. By using one or more additional subframes like the first subframe 158 in between the first and second subframes, a deck assembly of a larger size may be constructed.

The basic play unit 12 shown in FIG. 1 is a deck assembly having four posts 24–27 corresponding to the posts of the deck assembly 23. However, a basic play unit may be either a deck assembly 23 of the first embodiment, a deck assembly 58 of the second embodiment, or a deck assembly 150 of a third embodiment. The adjunct play units (14–22) all include anchor portions and connector portions, generally indicated at 84 and 86, respectively. The anchor portions 84 are generally spaced from the basic play unit 12 and are secured adjacent the basic play unit in a suitable fashion such as by burying in the ground. The connector portions 86 connecting the adjunct play units to the basic play unit 12 are brackets having a first leg and a second leg extending generally perpendicularly with respect to each other. The first and second bracket legs are configured for face-to-face engagement with two adjoining faces of the basic play unit 12, as is described more fully below.

The adjunct play unit 14 is a deck assembly substantially identical to the basic play unit 12, positioned at a lower height than basic play unit and adjunct play unit 16. The anchor portion 84 of the adjunct play unit 12 is the lower portion of two adjunct posts 88, 90, which is buried in the ground. The adjunct posts 88, 90 form, in cooperation with the two posts 26, 27 of the first post formation of the basic play unit 12 a second generally rectangular post formation. The adjunct play unit 14 has a second frame having first and second generally parallel side rails extending from the two posts 26, 27 of the first post formation to respective adjunct posts 88, 90. A third side rail of the adjunct play unit frame extends between the adjunct posts 88, 90 and a fourth side rail extends between the posts 26, 27 of the first formation. The connector portions 86 are two corner brackets (not shown, but identical to corner brackets 34) located at the ends of the first and second side rails and at the ends of the fourth side rail. The corner brackets have first and second legs extending generally at right angles to one another which are arranged for face-to-face engagement with the posts 26, 27 of the basic play unit 12. The corner bracket legs of the adjunct play unit 14 are attached by fasteners to the posts 26, 27 and engage the posts over a large area for a rigid and stable connection. Similar brackets (not shown) at the ends of the first and second rails and fourth side rail allow attachment of the side rails to the adjunct posts 88, 90.

The adjunct play unit 16 is a deck assembly like the deck assembly 58 of the third embodiment of the invention. The anchor portion 84 of the adjunct play unit 16 is the lower portion of three additional adjunct posts 98, 99 and 100, which are buried in the ground. The connector portion 86 includes a U-shaped bracket not shown, (identical to U-shaped bracket 78) and a corner bracket (not shown, but identical to the corner brackets 72). Either of the side legs (e.g., side legs 78A or 78B) of the U-shaped bracket corresponds to the first leg of the connector portion 86, and the connecting leg (e.g., connecting leg 78C) corresponds to the second leg of the connector portion. The remaining side leg engages a third face of the post 26, and provides additional rigidity and stability for the playground system 10.

Figure 5:
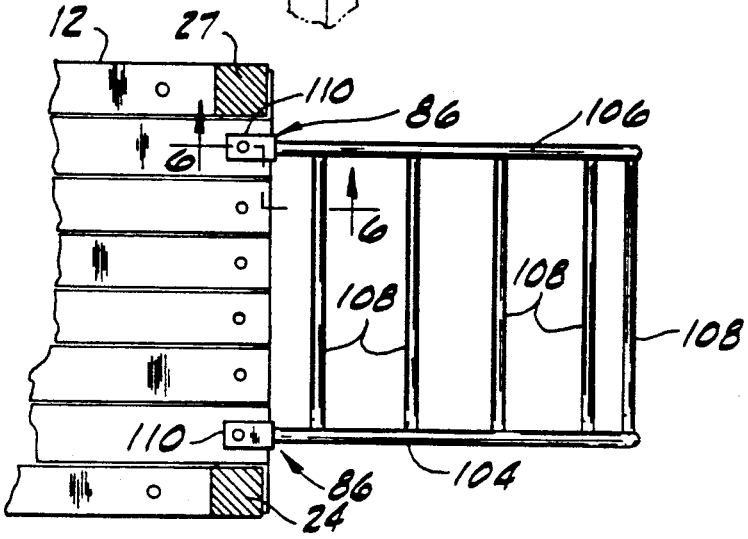
FIG. 5 is a fragmentary plan of a basic play unit and an adjunct play unit attached thereto.
Figure 6:
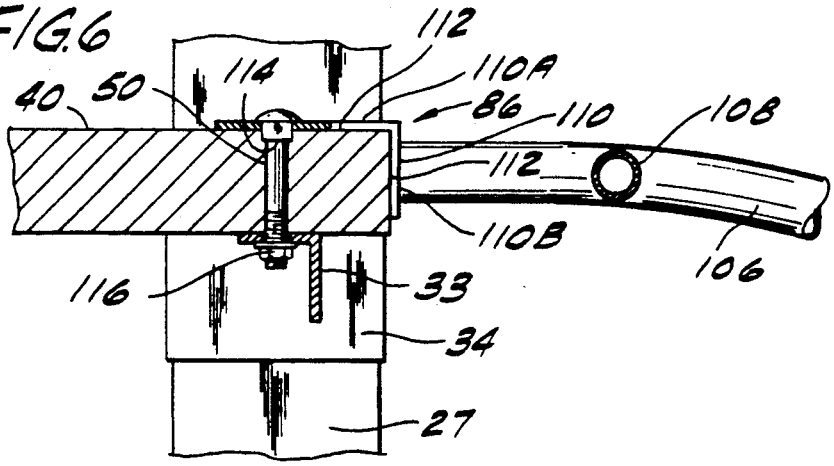
FIG. 6 is a cross section taken in the plane including line 6—6 of FIG. 5.

The arch (adjunct play unit 18), as shown in FIGS. 5 and 6, has two spaced apart curved members 104, 106 connected together by transversely extending rungs 108. The lower portions of the curved members 104, 106 are buried in the ground and constitute the anchor portion 84 of the adjunct play unit 18. The connector portion 86 includes brackets, indicated in their entireties by reference numeral 110, attached to the upper ends of the curved members 104, 106. The brackets 110 have a first leg 110A and a second leg 110B extending at right angles to the first leg, which are arranged for face-to face engagement with adjoining faces 112 of a deck board 40 (FIG. 6). Unlike the connector portions 86 of the adjunct play units 14, 16 or 20, the first legs 110A of the brackets (connector portions) lie in generally horizontal planes. The brackets 110 are secured to the basic play unit 12 by a fastener including a bolt 114, which extends through a hole in the first leg 110A aligned with a bore 50 of the deck board 40 and a hole 46 in the side rail, respectively, and a nut 116.

Figure 7:
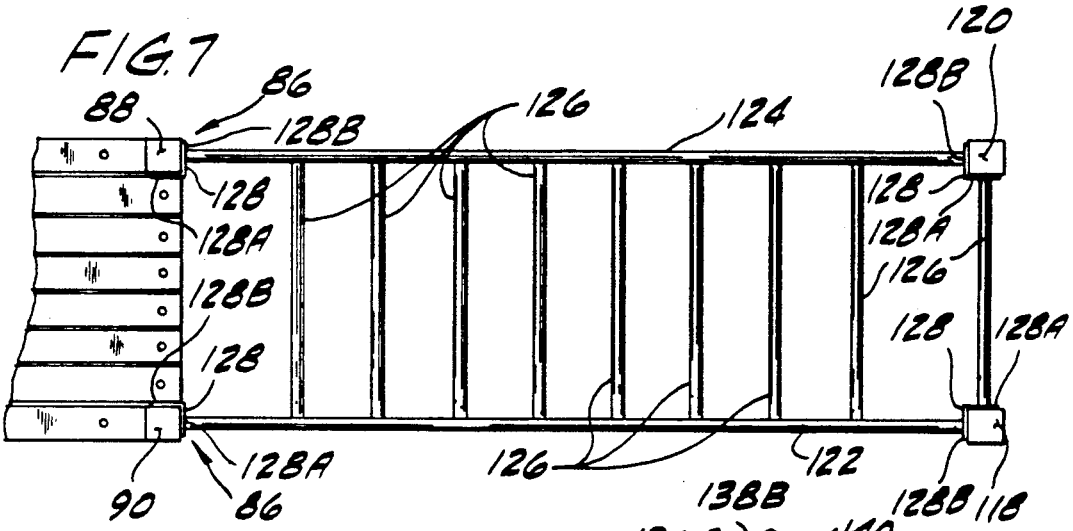
FIG. 7 is a fragmentary plan view of a basic play unit and a second type of adjunct play unit attached thereto.

The adjunct play units 20 (overhead bars) and 22 (slide) are connected to adjunct play units 14 and 16, respectively. The anchor portion 84 of the overhead bars 20 comprises the lower portions of adjunct posts 118, 120 which are buried in the ground. As shown in FIG. 7, the overhead bars 20 include a pair of opposing rails 122, 124 connected together by rungs 126. Connector brackets 128 include a first leg 128A and a second leg 128B extending at right angles to the first leg. The two connector brackets 128 secured to the adjunct posts 88, 90 of the adjunct play unit 14 constitute connector portions 86 in this embodiment. The other two connector brackets 128 are connected to the adjunct posts 118, 120. The slide 22 has a sliding surface portion 130 and anchor poles (not shown) at the lower end of the sliding surface portion away from the adjunct play unit 16, which are buried in the ground. The connecting portion 86 of the slide 22 comprises a connector bracket 132 attached at the upper end of the sliding surface portion 130. The bracket 132 is substantially identical to the bracket 110 of the arch 18, and includes a first leg 132A extending in a generally horizontal plane, and a second leg (not shown) extending in a generally vertical plane. The first leg 132 has holes in it arranged for alignment with the holes in the side rails of the adjunct play unit 16, and is connected to the adjunct play unit by suitable fasteners extending through aligned holes in the underlying deck boards 40 and side rails.

Thus, it may be seen that with the addition of each adjunct play unit to the playground system 10, the system becomes more rigid and stable. This is because each adjunct play unit includes an anchor portion 84 which is anchored adjacent the basic play unit such as by burying in the ground to provide additional stability and rigidity, and a connector portion 86 with first and second legs which engage the basic play unit 12 (or another adjunct play unit) over a large surface area. It is to be understood that the anchor portions 84 could be secured in other ways than by burying and still fall within the scope of the invention. Moreover, the uniform use of connector portions 86 with holes located for aligning with openings in the side rails (and deck boards 40) allows the systems to be rapidly assembled and allows a large degree of flexibility in arranging the various component play units of a system.

Figure 8:
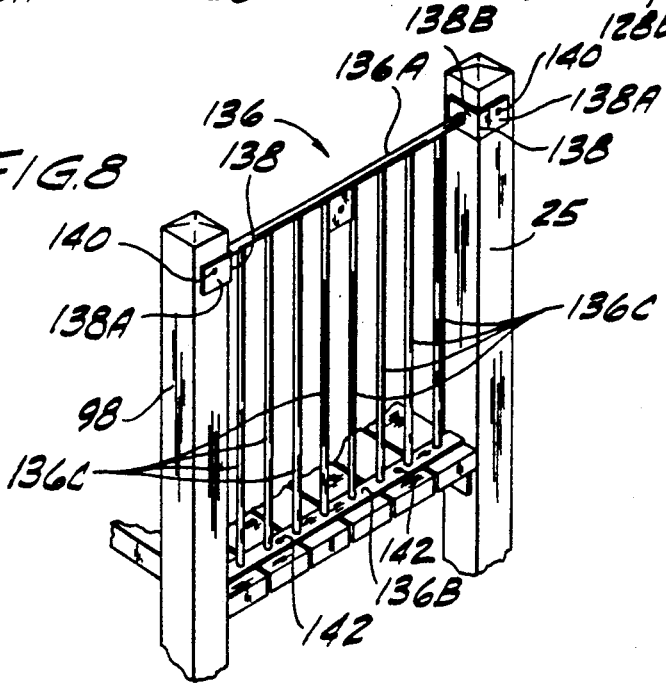
FIG. 8 is a fragmentary perspective of side railing attached to a deck assembly.

A number of the posts of the deck assemblies in the playground system 10 shown in FIG. 1 extend above the decking of the corresponding deck assembly. Guard walls indicated generally at 136 are mounted between adjacent pairs of posts above the decking. As shown in FIG. 8, the guard walls 136 include a top rail 136A and a bottom rail 136B made of metal and a plurality of metal bars 136C extending between the top and bottom rails at spaced intervals lengthwise of the rails. A pair of metal wall brackets 138 similar in construction to the corner brackets 128 of the adjunct play unit 20 described above are attached to the ends of the top rail. The wall brackets have a first leg 138A and a second leg 138B which extends at right angles to the first leg. The wall brackets 138 receive adjoining faces of the posts 25, 98 with the legs 138A, 138B in face-to-face engagement with the adjoining post faces. The legs 138A, 138B have holes 140 in them for receiving fasteners for connecting the wall brackets 136 to the posts. The bottom rail 136B has two holes 142 in it located for aligning with bores 50 in two deck boards 40 and the underlying side rail for receiving fasteners (e.g., a nut and bolt) for connecting the bottom rail to the deck assembly.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A deck assembly for playground equipment, said assembly comprising, four corner posts adapted to be installed upright in a generally rectangular post formation with the posts at the corners of the formation, each post having a pair of adjoining faces lying in generally perpendicular planes, a generally rectangular frame defined by a plurality of side rails at respective sides of the frame, four corner brackets at the four corners of the frame, each bracket having first and second legs extending generally at right angles to one another for face-to-face engagement with said pair of adjoining faces of a respective post, and means for fastening the brackets to the posts with the side rails in a generally horizontal plane and with the posts received in said corner brackets with the first and second legs of each bracket in engagement with said pair of adjoining faces of a respective post, the first and second legs of each corner bracket being dimensioned for engaging said pair of adjoining faces of a respective post over large areas of the post whereby when the brackets are fastened to the posts, the posts and frame are rigidly connected to form a stable unit, and deck boards secured alongside one another to the side rails to form decking overlying the frame, each side rail comprising a top leg lying in a generally horizontal plane, and a depending side leg extending generally at right angles to the top leg, the top leg having a plurality of fastener holes therein for receiving fasteners to fasten deck boards to the rail, the frame being symmetric about first central vertical plane of the frame extending generally at right angles to a pair of parallel side rails of the frame, wherein the top leg of each side rail has a width less than the length of the leg of the respective corner bracket to which it is attached.

2. A deck assembly for playground equipment, said assembly comprising, four corner posts adapted to be installed upright in a generally rectangular post formation with the posts at the corners of the formation, each post having a pair of adjoining faces lying in generally perpendicular planes, a generally rectangular frame defined by a plurality of side rails at respective sides of the frame, four corner brackets at the four corners of the frame, each bracket having first and second legs extending generally at right angles to one another for face-to-face engagement with said pair of adjoining faces of a respective post, and means for fastening the brackets to the posts with the side rails in a generally horizontal plane and with the posts received in said corner brackets with the first and second legs of each bracket in engagement with said pair of adjoining faces of a respective post, the first and second legs of each corner bracket being dimensioned for engaging said pair of adjoining faces of a respective post over large areas of the post whereby when the brackets are fastened to the posts, the posts and frame are rigidly connected to form a stable unit, and deck boards secured alongside one another to the side rails to form decking overlying the frame, each side rail comprising a top leg lying in a generally horizontal plane, and a depending side leg extending generally at right angles to the top leg, the top leg having a plurality of fastener holes therein for receiving fasteners to fasten deck boards to the rail, the frame being symmetric about first central vertical plane of the frame extending generally at right angles to a pair of parallel side rails of the frame, wherein the top leg of each of two side rails at opposite sides of the frame has a width about the same as the length of the leg of the respective corner bracket to which it is attached.

3. A deck assembly for playground equipment, said assembly comprising, four corner posts adapted to be installed upright in a generally rectangular post formation with the posts at the corners of the formation, each post having a pair of adjoining faces lying in generally perpendicular planes, a generally rectangular frame defined by a plurality of side rails at respective sides of the frame, four corner brackets at the four corners of the frame, each bracket having first and second legs extending generally at right angles to one another for face-to-face engagement with said pair of adjoining faces of a respective post, each corner bracket being generally L-shaped and the first and second legs of the bracket opening outwardly away from the interior of the rectangular frame, and means for fastening the brackets to the posts with the side rails in a generally horizontal plane and with the posts received in said corner brackets with the first and second legs of each bracket in engagement with said pair of adjoining faces of a respective post, the first and second legs of each corner bracket being dimensioned for engaging said pair of adjoining faces of a respective post over large areas of the post whereby when the brackets are fastened to the posts, the posts and frame are rigidly connected to form a stable unit, and deck boards secured alongside one another to the side rails to form decking overlying the frame.

4. A deck assembly as set forth in claim 3 wherein the frame comprises first and second generally rectangular subframes each defined by four side rails, one at each side of the subframe, aligned side rails of the first and second subframes defining two of the sides of the frame and opposing side rails of the respective subframes defining the other two sides of the frame, the remaining side rails of the subframes being disposed generally adjacent one another.

5. A deck assembly for playground equipment, said assembly comprising, four corner posts adapted to be installed upright in a generally rectangular post formation with the posts at the corners of the formation, each post having a pair of adjoining faces lying in generally perpendicular planes, a generally rectangular frame defined by a plurality of side rails at respective sides of the frame, for corner brackets at the four corners of the frame, each bracket having first and second legs extending generally at right angles to one another for face-to-face engagement with said pair of adjoining faces of a respective post, and means for fastening the brackets to the posts with the side rails in a generally horizontal plane and with the posts received in said corner brackets with the first and second legs of each bracket in engagement with said pair of adjoining faces of a respective post, the first and second legs of each corner bracket being dimensioned for engaging said pair of adjoining faces of a respective post over large areas of the post whereby when the brackets are fastened to the posts, the posts and frame are rigidly connected to form a stable unit, deck boards secured alongside one another to the side rails to form decking overlying the frame, a pair of side posts adapted to be installed in said rectangular post formation so that there are three posts along one side of the formation and three posts along an opposite side of the formation, two of the side rails at opposite sides of the frame including a pair of generally U-shaped brackets for receiving said side posts therein.

6. A deck assembly as set forth in claim 5 wherein each generally U-shaped bracket opens outwardly away from the interior of the frame and comprises two opposing side legs extending generally perpendicular to the length of its respective side rail, and a connecting leg joining the two opposing legs and extending generally parallel to the length of its respective side rail.

7. A deck assembly as set forth in claim 5 wherein each of the two side rails at opposite sides of the frame comprises a top leg lying in a generally horizontal plane, and a depending side leg extending generally at right angles to the top leg, the top leg having a plurality of fastener holes therein for receiving fasteners to fasten deck boards to the rail, said connecting leg of each U-shaped bracket being an integral extension of the depending leg of its respective side rail, and the opposing side legs of the U-shaped bracket being integrally connected to the top leg of its respective side rail.

8. A deck assembly for playground equipment, said assembly comprising, four corner posts adapted to be installed upright in a generally rectangular post formation with the posts at the corners of the formation, each post having a pair of adjoining faces lying in generally perpendicular planes, a generally rectangular frame defined by a plurality of side rails at respective sides of the frame, four corner brackets at the four corners of the frame, each bracket having first and second legs extending generally at right angles to one another for face-to-face engagement with said pair of adjoining faces of a respective post, and means for fastening the brackets to the posts with the side rails in a generally horizontal plane and with the posts received in said corner brackets with the first and second legs of each bracket in engagement with said pair of adjoining faces of a respective post, the first and second legs of each corner bracket being dimensioned for engaging said pair of adjoining faces of a respective post over large areas of the post whereby when the brackets are fastened to the posts, the posts and frame are rigidly connected to form a stable unit, deck boards secured alongside one another to the side rails to form decking overlying the frame, the frame comprising first and second generally rectangular subframes each defined by four side rails, one at each side of the subframe, aligned side rails of the first and second subframes defining two of the sides of the frame and opposing side rails of the respective subframes defining the other two sides of the frame, the remaining side rails of the subframes being disposed generally adjacent one another, four side posts adapted to be installed in the rectangular post formation generally intermediate the corner posts, and a center post located generally in the middle of the rectangular post formation, the center post having a generally flat top surface lying generally in a plane below an upper surface of the deck boards as mounted on the frame.

9. A deck assembly as set forth in claim 8 wherein each subframe includes two of the corner brackets, and a generally U-shaped bracket, the U-shaped bracket of said first subframe being disposed for receiving one of said side posts therein, and the U-shaped bracket of the second subframe being disposed for receiving the center post therein.

10. A playground system comprising a basic play unit comprising at least four posts installed upright in a first generally rectangular post formation with posts at the corners of the formation, a rectangular frame including four side rails, one at each side of the frame, means fastening the side rails to the posts at the four corners of the frame with the side rails in a generally horizontal plane thereby to provide a rigid, stable structure, and deck boards secured alongside one another to the side rails to form decking overlying the frame, and at least one adjunct play unit for installation as an adjunct to the basic play unit, said adjunct play unit comprising an anchor portion adapted to be anchored adjacent the basic play unit as by burying in the ground, and a connector portion for connecting the adjunct play unit to the basic play unit, the connector portion comprising a bracket having first and second legs extending generally at right angles to one another, said first and second legs engaging adjoining faces of the basic play unit, and means for fastening the bracket to the basic play unit, wherein the first leg of the bracket lies in a generally horizontal plane and the second leg lies in a generally vertical plane, the first and second legs being adapted for face-to-face engagement with a pair of adjoining faces of one of the deck boards.

11. A playground system comprising a basic play unit comprising at least four posts installed upright in a first generally rectangular post formation with the posts at the corners of the formation, the posts having openings therein, a rectangular frame including four side rails having openings therein, one at each side of the frame, means fastening the side rails to the posts at the four corners of the frame with the side rails in a generally horizontal plane thereby to provide a rigid, stable structure, deck boards having openings therein adapted to be aligned with the openings in the side rails when the deck boards are placed alongside one another on the side rails, and fasteners adapted for reception in the aligned openings to secure the deck boards to the side rails, and at least one adjunct play unit for installation as an adjunct to the basic play unit, said adjunct play unit comprising an anchor portion adapted to be anchored adjacent the basic play unit as by burying in the ground, and a connector portion for connecting the adjunct play unit to the basic play unit, the connector portion comprising a bracket having an opening therein adapted to be aligned with one of the openings in the side rails or the posts for receiving one of the fasteners therethrough to secure the adjunct play unit to the basic play unit.

12. A playground system as set forth in claim 11 wherein the connector portion of the adjunct play unit comprises a pair of brackets having openings therein, the brackets being located at spaced apart locations on the adjunct play unit, the spacing between the bracket openings corresponding to the spacing between a pair of the openings in the basic play unit.

13. A playground system as set forth in claim 11 wherein the connector portion of the adjunct play unit comprises a pair of brackets located at spaced apart locations, the spacing between the pair of brackets corresponding to the spacing between two of the posts in the first generally rectangular post formation.

* * * * *

UNITED STATES PATENT AND TRADEMARK OFFICE

CERTIFICATE OF CORRECTION

PATENT NO. : 5,230,186

DATED : July 27, 1993

INVENTOR(S) : G. Thomas Hammonds et al.

It is certified that error appears in the above-identified patent and that said Letters Patent is hereby corrected as shown below:

Column 10, claim 5, lines 18-19, "frame, for corner", should read ---frame, four corner---.

Signed and Sealed this

Twenty-sixth Day of April, 1994

Bruce Lehman

*Attest:*

BRUCE LEHMAN

*Attesting Officer*

*Commissioner of Patents and Trademarks*